US006520627B2

(12) United States Patent
Chen et al.

(10) Patent No.: US 6,520,627 B2
(45) **Date of Patent: *Feb. 18, 2003**

(54) DIRECT IMAGING POLYMER FLUID JET ORIFICE

(75) Inventors: Chien-Hau Chen, Corvallis, OR (US); Donald E. Wenzel, Corvallis, OR (US); Qin Liu, Corvallis, OR (US); Naoto Kawamura, Corvallis, OR (US); Richard W. Seaver, Corvallis, OR (US); Carl Wu, Corvallis, OR (US); Colby Van Vooren, Corvallis, OR (US); Jeffery S. Hess, Corvallis, OR (US); Colin C. Davis, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/062,807

(22) Filed: Feb. 1, 2002

(65) Prior Publication Data

US 2002/0071006 A1 Jun. 13, 2002

Related U.S. Application Data

(63) Continuation of application No. 09/605,081, filed on Jun. 26, 2000.

(51) Int. Cl.[7] ..... B41J 2/05; B41J 2/135
(52) U.S. Cl. ..... 347/63; 347/44; 347/47
(58) Field of Search ..... 347/63, 44, 47; 430/320

(56) References Cited

U.S. PATENT DOCUMENTS

| | | | | |
|---|---|---|---|---|
| 4,394,670 A | | 7/1983 | Sugitani et al. | 346/140 R |
| 4,456,371 A | | 6/1984 | Lin | 355/71 |
| 4,789,425 A | | 12/1988 | Drake et al. | 156/644 |
| 5,160,577 A | | 11/1992 | Deshpande | 156/644 |
| 5,198,834 A | | 3/1993 | Childers et al. | 346/1.1 |
| 5,278,584 A | | 1/1994 | Keefe et al. | 346/140 R |
| 5,331,344 A | * | 7/1994 | Miyagawa et al. | 347/63 |
| 5,376,483 A | | 12/1994 | Rolfson | 430/5 |
| 5,658,471 A | | 8/1997 | Murthy et al. | 216/27 |
| 5,686,224 A | | 11/1997 | O'Neill | 430/320 |
| 6,045,215 A | | 4/2000 | Coulman | 347/47 |

FOREIGN PATENT DOCUMENTS

| | | | |
|---|---|---|---|
| EP | 0244214 A1 | 11/1987 | B41J/3/04 |
| EP | 0491560 A2 | 6/1992 | B41J/2/16 |
| EP | 0734866 A2 | 10/1996 | B41J/2/16 |

OTHER PUBLICATIONS

Arnost Reiser, Photoreactive Polymers: The Science and Technology of Resists; John Wiley & Sons; Feb. 1989; ISBN: 0471855502; pp. 184–187.

* cited by examiner

*Primary Examiner*—John Barlow
*Assistant Examiner*—Manish S. Shah
(74) *Attorney, Agent, or Firm*—Timothy F. Myers

(57) ABSTRACT

A process for creating and an apparatus employing shaped orifices in a semiconductor substrate. A first layer of material is applied on the semiconductor substrate then a second layer of material is then applied upon the first layer of material. An orifice image is then transferred to the first layer of material and a fluid-well image is transferred to the second layer of material. That portion of the second layer of material where the orifice image is located is then developed along with that portion of the first layer of material where the fluid well is located to define an orifice in the substrate.

9 Claims, 16 Drawing Sheets

DIRECT IMAGING POLYMER FLUID JET ORIFICE

CROSS REFERENCE TO RELATED APPLICATION

This is a continuation of copending application No. 09/605,081 filed on Jun. 26, 2000 which is hereby incorporated by reference herein.

BACKGROUND OF THE INVENTION

This invention generally relates to thermal inkjet printing. More particularly, this invention relates to the apparatus and process of manufacturing precise polymer orifices comprising epoxy, polyimide or other negative acting photoresist material using direct imaging techniques.

Thermal inkjet printers typically have a printhead mounted on a carriage that traverses back and forth across the width of the paper or other medium feeding through the printer. The printhead includes an array of orifices (also called nozzles) which face the paper. Ink (or another fluid) filled channels feed the orifices with ink from a reservoir ink source. Applied individually to addressable energy dissipation elements (such as resistors), energy heats the ink within the orifices causing the ink to bubble and thus expel ink out of the orifice toward the paper. Those skilled in the art will appreciate that other methods of transferring energy to the ink or fluid exist and still fall within the spirit, scope and principle of the present invention. As the ink is expelled, the bubble collapses and more ink fills the channels from the reservoir, allowing for repetition of the ink expulsion.

Current designs of inkjet printheads have problems in their manufacturing, operating life and accuracy in directing the ink onto the paper. Printheads currently produced comprise an inkfeed slot through a substrate, a barrier interface (The barrier interface channels the ink to the resistor and defines the firing chamber volume. The barrier interface material is a thick, photosensitive material that is laminated onto the substrate, exposed, developed, and cured.), and an orifice plate (The orifice plate is he exit path of the firing chamber that was defined by the barrier interface. The orifice plate is typically electroformed with nickel (Ni) and then coated with gold (Au), palladium (Pd), or other precious metals for corrosion resistance. The thickness of the orifice plate and the orifice opening diameter are controlled to allow repeatable drop ejection when firing). During manufacturing, aligning the orifice plate to the substrate with barrier interface material requires special precision and special adhesives to attach it. If the orifice plate is warped or if the adhesive does not correctly bond the orifice plate to the barrier interface, poor control of the ink drop trajectory results and the yield or life of the printhead is reduced. If the alignment of the printhead is incorrect or the orifice plate is dimpled (non-uniform in its planarization), the ink will be ejected away from its proper trajectory and the image quality of the printout is reduced. Because the orifice plate is a separate piece in conventionally constructed printheads, the thickness required to prevent warping or buckling during manufacturing requires the height (related to thickness of the orifice plate) of the orifice bore to be higher than necessary for thermal efficiency. Usually, a single orifice plate is attached to a single printhead die on a semiconductor wafer that contains many printheads. It is desirable to have a process that allows for placement of the orifice plates all at once across an entire semiconductor wafer to increase productivity as well as ensure accuracy of orifice placement.

The ink within the firing chamber fills the orifice bore up to the external edges of the orifice plate. Thus, another problem with this increased height of ink in the orifice bore is that it requires more energy to eject the ink. Additionally, high quality photo printing requires higher resolutions and thus smaller drops of ink. Therefore, a need for a thinner orifice plate that is manufacturable exists. Furthermore, as the quantity of ink expelled in each drop becomes smaller, more orifices are required within the printhead to create a given pattern in a single passing of the printhead over the print medium at a fixed print speed. To prevent the printhead from overheating due to the increased number of orifices, the amount of energy used per orifice must be reduced.

Additionally, in the past, the lifetime of the printhead was adequate. The printhead was part of a disposable pen that was replaced after the ink supply ran out. However, user expectations for quality are driving the need to have a low cost, long life printhead with multiyear permanence and the present invention helps fulfill this expectation.

SUMMARY OF THE INVENTION

A process for creating and an apparatus employing shaped orifices in a semiconductor substrate is described. A first layer of material is applied on the semiconductor substrate then a second layer of material is then applied upon the first layer of material. An orifice image is then transferred to the second layer of material and a fluid-well image is transferred to the first layer of material. That portion of the second layer of material where the orifice image is located is then developed along with that portion of the first layer of material where the fluid well is located to define an orifice in the substrate.

The volume of the orifice chamber is defined by the orifice image shape and the thickness of the second layer of material. The volume of the fluid-well chamber is defined by the fluid-well image shape and the thickness of the first layer of material.

DETAILED DESCRIPTION OF THE PREFERRED AND ALTERNATE EMBODIMENTS

Figure 1A:
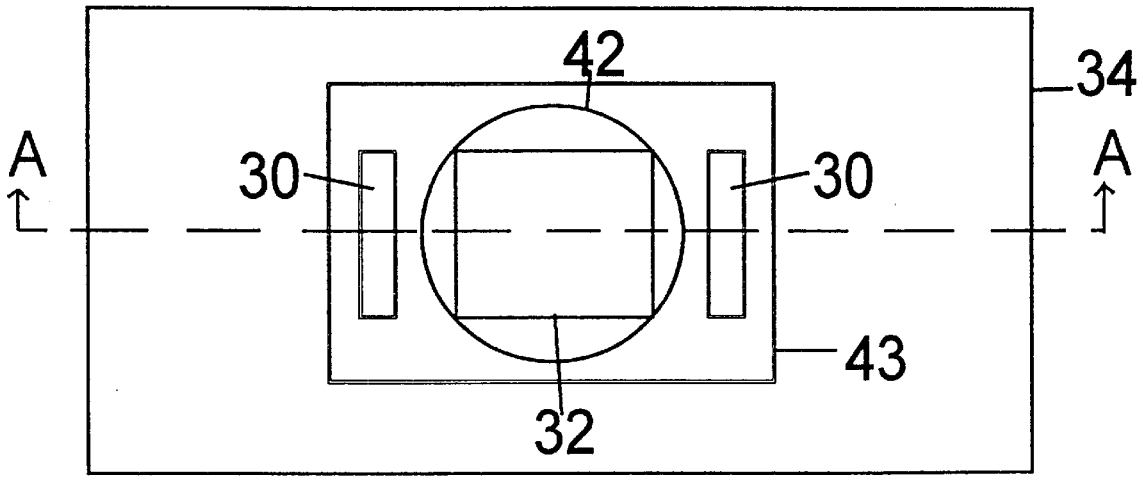
FIG. 1A illustrates the top view of a single orifice of the preferred embodiment.

The invention relates to a novel polymer orifice fabrication process that creates a multi-material sandwich of photoimagable layers over the substrate and that does not require a Ni orifice plate or barrier interface material. Each photoimagable layer has different rate of cross-linking for a given intensity of energy. Additionally, the invention encompasses a design topology using the photoimagable layers that produces a top-hat shaped reentrant (directed inwards) profile orifice. The top-hat orifice can be tailored by varying process parameters to optimize drop ejection characteristics. This top-hat design topology offers several advantages over straight walled or linear tapered architectures. The top-hat shaped reentrant orifice chamber, which ejects the fluid drops, is easily defined by a fluid-well chamber and an orifice chamber. The area and shape of each chamber, as viewed looking into the orifice, is defined by using a patterned mask or set of masks. The masks allow for controlling the entrance diameter, exit diameter and firing chamber volume based on the orifice layer thickness or height. The height of the orifice chamber and the height of the fluid-well chamber are independently controlled to allow for optimum process stability and design latitude. By controlling the shape, area and height of the orifice and fluid-well chambers, the designer can control the drop size, drop shape, and dampen the effect of the blowback (that part of the bubble which expels the ink that expands opposite to the direction of drop ejection) and to some extent the refill speed (the time required to have ink fill the entire top-hat orifice structure). In addition, this top-hat topology allows the fluid feed slots, which deliver fluid to the orifice, to be placed further away from the energy dissipation element used to eject the fluid to reduce the possibility of the bubble entering the fluid supply path and thus creating a blockage.

The direct imaging polymer orifice normally comprises two or more layers of negative acting photoresist materials with slightly different dissolution rates. The dissolution rates are based on the different materials of each layer having a different molecular weight, physical composition, or optical density. In an exemplary process using two layers, a "slow" photoresist that requires 500 mJoules/cm$^2$ intensity of electromagnetic energy for cross-linking is applied on a substrate. In an fluid-jet printhead this substrate is comprised of a semiconductor material that has had a stack of thin-film layers applied to its surface. A "fast" photoresist that requires just 100 mJoules/cm$^2$ intensity of electromagnetic energy for cross-linking is applied on the layer of slow photoresist. After curing, the substrate photoresist layers are exposed through a mask at a very high intensity of at least 500 mJoules/cm$^2$ to define the fluid-well chamber. The intensity is high enough to cross-link both the top and lower layers. The substrate photoresist layers are then exposed through another mask with low intensity electromagnetic energy of 100 mJoules/cm$^2$ to define the orifice chamber. It is important that the intensity of the second exposure below enough so the lower orifice layer of slow photoresist that is beneath the orifice opening is not cross-linked.

Polymer material is well known in the IC industry for its ability to planarize over thin-film topographies. Empirical data shows that orifice plate topography variation can be kept well within 1 micron. This feature is important to provide a consistent drop trajectory.

In addition, many different polymer materials having negative acting photoresist properties exist. Exemplary polymer materials are polyimide, epoxy, polybenzoxazoles, benzocyclobutene, and sol gels. Those skilled in the art will appreciate that other negative acting photoresist polymer materials exist and still fall within the spirit and scope of the invention. By adding optical dye (such as Orange #3, ~2% weight) to transparent polymer material, a slow photoresist can be made from fast photoresist that has no dye or a small amount of dye. Another embodiment would be to coat a layer of polymer material with a thin layer of dye. Alternative methods to create slow photoresist comprise mixing polymers with different molecular weights, with different wavelength absorption characteristics, with different developing rates, and using pigments. Those skilled in the art will appreciate that other methods to slow the photosensitivity of polymers exist and still fall within the spirit and scope of the invention.

FIG. 1A illustrates the top view of a single orifice 42 (also called a nozzle or a hole) using the preferred embodiment of the present invention. Top orifice layer 34 is comprised of fast cross-linking polymer such as photoimagable epoxy (such as SU8 developed by IBM) or photoimagable polymer (such as OCG, commonly known in the art). The top orifice layer 34 is used to define the shape and height of the orifice 42 opening. Hidden within the orifice layer are fluid feed slots 30 and a fluid-well 43. Fluid, such as ink, flows into the fluid-well 43 through the fluid feed slots 30 and is heated by energy dissipation element 32 forming a fluid vapor bubble that forcibly ejects the remaining fluid from the orifice 42. View AA shows the direction of observation for the cross-sectional views in later figures.

Figure 1B:
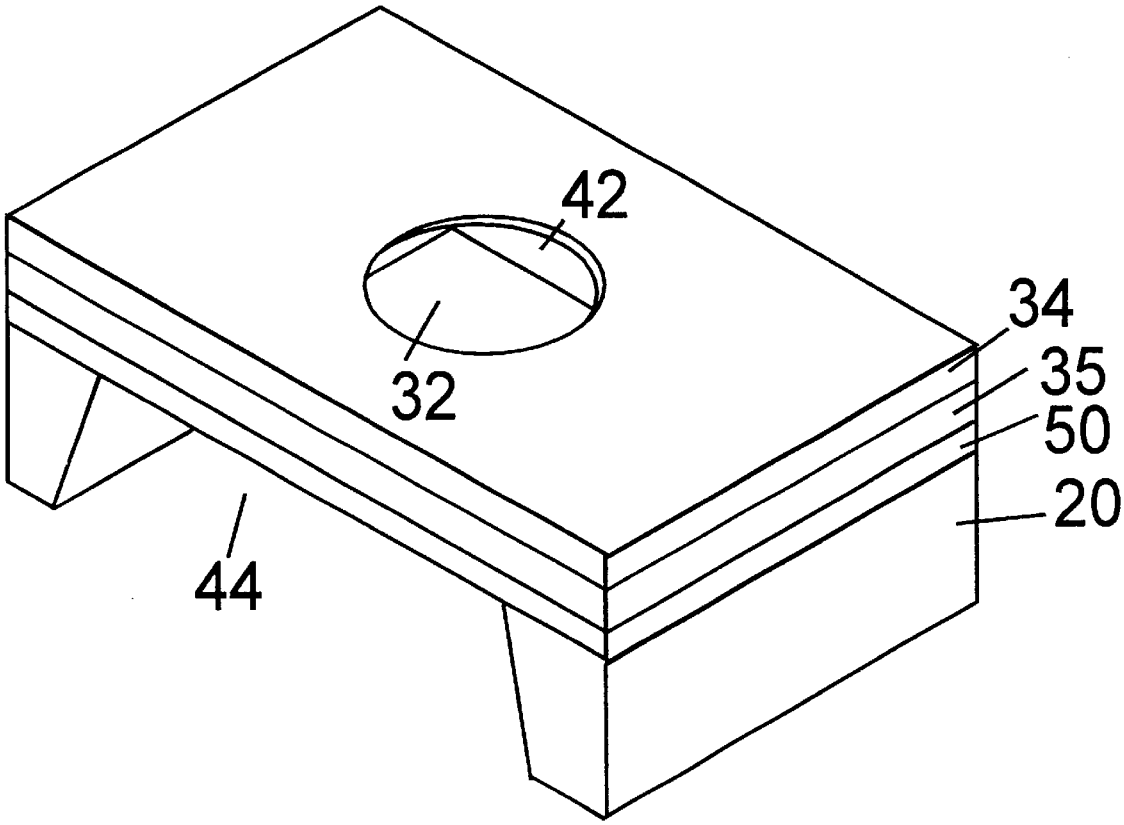
FIG. 1B is an isometric cross sectional view of the orifice illustrating the basic structure.

FIG. 1B is an isometric cross-sectional view of the single orifice shown in FIG. 1A of a fully integrated thermal (FIT) fluid jet printhead. Lower orifice layer 35 is applied on top of a stack of thin-film layers 50, which have been processed by individual layers and incorporated onto the surface of a semiconductor substrate 20. An examplary orifice would have an orifice 42 diameter of 16 $\mu$m, a fluid-well 43 length of 42 $\mu$m, a fluid-well 43 width of 20 $\mu$m, a top orifice layer 34 thickness of 6 $\mu$m, and a lower orifice layer 35 thickness of 6 $\mu$m. Semiconductor substrate 20 is etched after the stack of thin-film layers 50 have been applied to provide fluid feed channel 44, which supplies fluid to the fluid feed slots 30 (not shown). Fluid feed slots 30 are defined within the stack of thin-film layers 50.

Figure 2A:
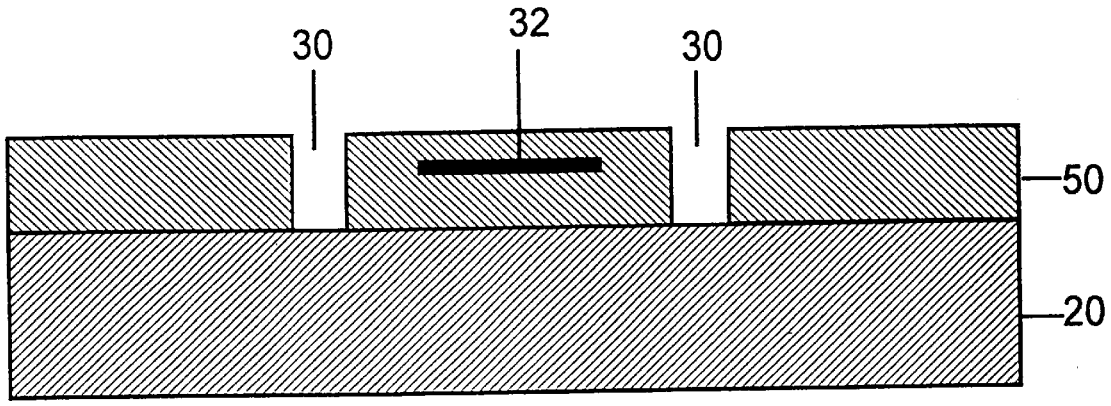
FIGS. 2A through 2H illustrate the process steps of the preferred embodiment to create an in-situ orifice. The cutaway view is the AA perspective from FIG. 1A.

FIGS. 2A through 2H illustrate the various process steps used to create alternative embodiments of the invention. FIG. 2A illustrates semiconductor substrate 20 after it has been processed to incorporate the stack of thin-film layers 50, which includes energy dissipation element 32. The stack of thin-film layers 50 has been processed such that fluid feed slots 30 extend through its entire thickness.

Figure 2B:
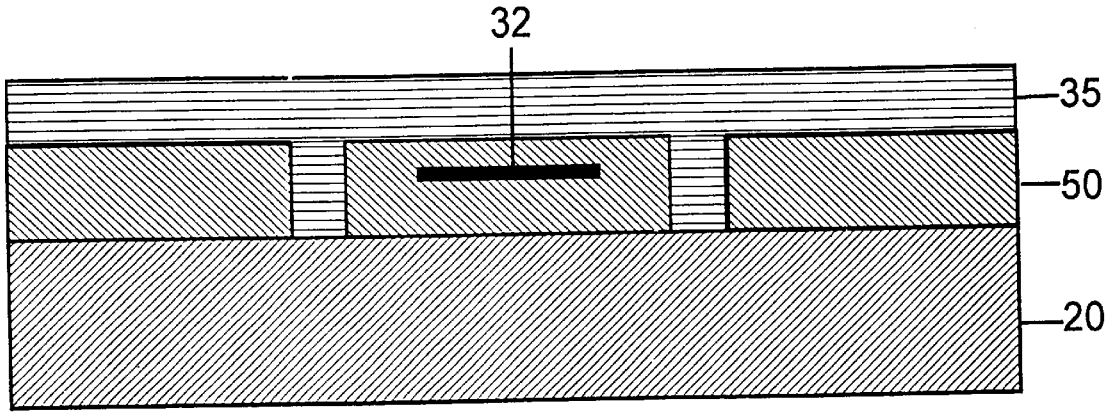

FIG. 2B illustrates the semiconductor substrate 20 after the lower orifice layer 35, comprised of a slow cross-linking polymer, is applied on top of the stack of thinfilm layers 50. The slow cross-linking polymer is applied using a conventional spincoating tool such as those manufactured by Karl Suss KG. The spin-coating process associated with the spin-coating tool allows for a planar surface to be formed as the slow cross-linking polymer 35 fills the fluid feed slots 30 and the surface of stack of thin-film layers 50. An examplary process for spin coating is to spread a layer of resist on a semiconductor wafer with the spin coating tool set to 70 rpm with an acceleration of 100 rpm/s and a spread time of 20 secs. The wafer is then stopped from spinning with a deceleration of 100 rpm/s and rests for 10 secs. The wafer is then spun at 1060 rpm at an acceleration rate of 300 rpm/s for 30 secs to spread the resist over the entire wafer. Alternative polymer application processes include rollcoating, curtain coating, extrusion coating, spray coating, and dip-coating. Those skilled in the art will appreciate that other methods to apply the polymer layers to the substrate exist and still fall within the spirit and scope of the invention. The slow cross-linking polymer is made by mixing optical dye (such as orange #3, ~2% weight) into either a photoimagable polyimide or photoimagable epoxy transparent polymer material. By adding the dye, the amount of electromagnetic energy required is greater than non-dye mixed material to cross-link the material.

Figure 2C:
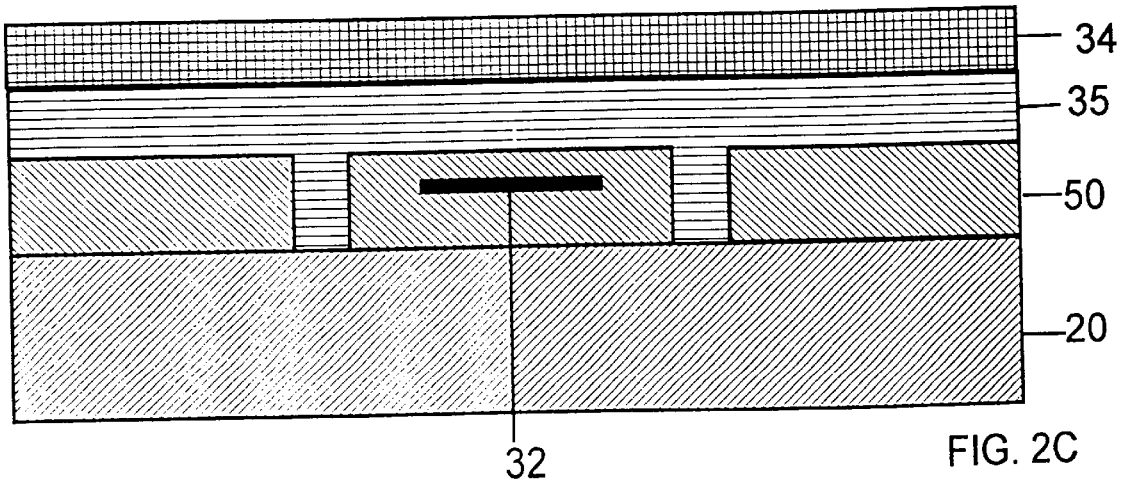

FIG. 2C illustrates the result of applying the top orifice layer 34 comprised of a fast cross-linking polymer on lower orifice layer 35.

Figure 2D:
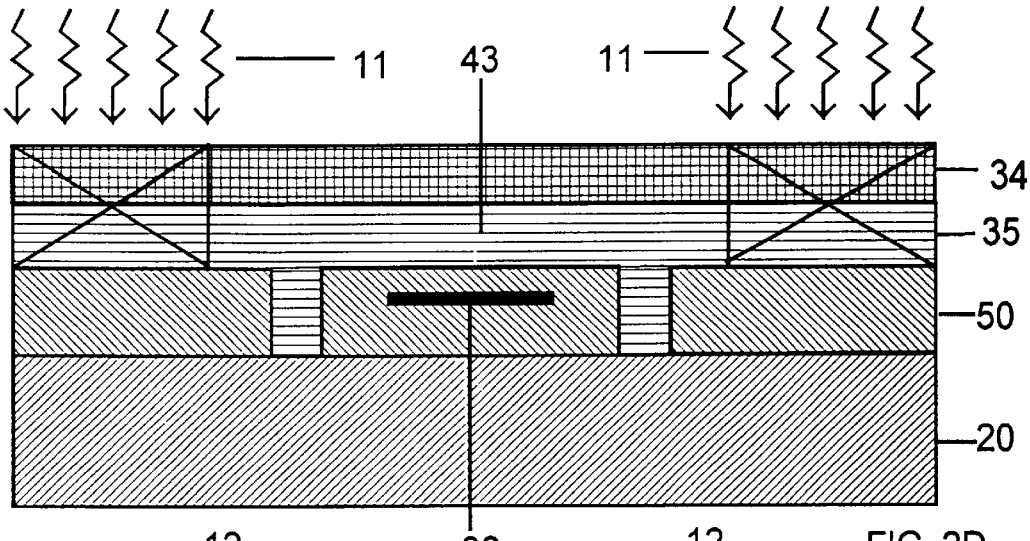

FIG. 2D illustrates a strong intensity of electromagnetic radiation 11 being applied to top orifice layer 34 and lower orifice layer 35. The energy supplied by the electromagnetic radiation must be sufficient to cross-link both the top orifice layer 34 and lower orifice layer 35 where exposed (shown in FIGS. 2D, 2E and 2F as X-out areas). In an examplary embodiment, this step is done using a SVG Micralign tool set at 300 mjoules with a focus offset of +9 $\mu$m. This step defines the shape and area of the fluid-well 43 in the orifice.

Figure 2E:
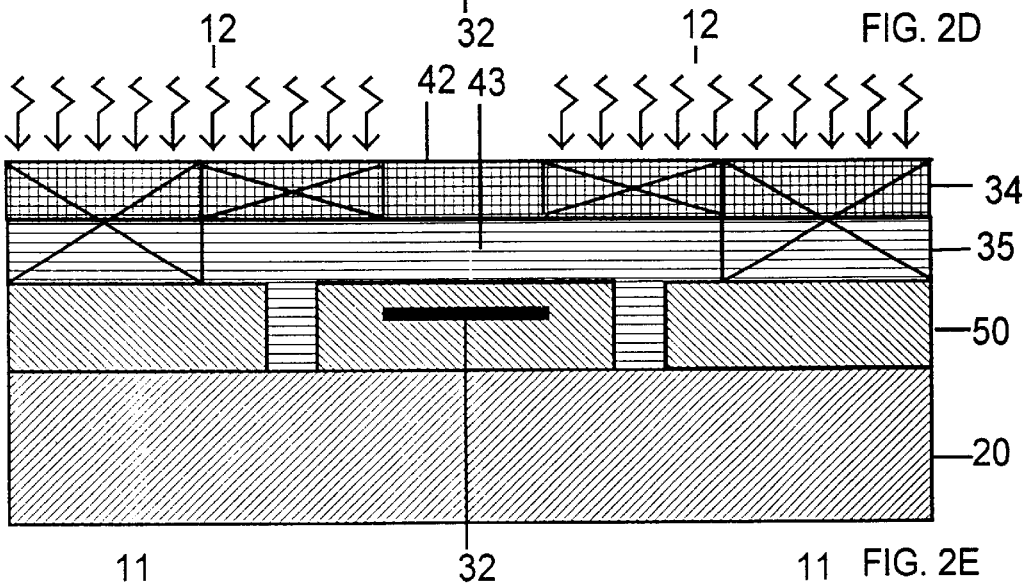

FIG. 2E illustrates the next step of the process in which a lower intensity of electromagnetic energy 12 is applied to the top orifice layer 34 and lower orifice layer 35. The total energy expended during this step (either by limiting the intensity or time of exposure or a combination of both) is only sufficient to cross-link the fast crosslinking polymer in top orifice layer 34. In an examplary embodiment, this step is done using a SVG Micralign tool set at 60.3 mjoules with a focus offset of +3 $\mu$m. This step defines the shape and area of orifice opening 42.

Figure 2F:
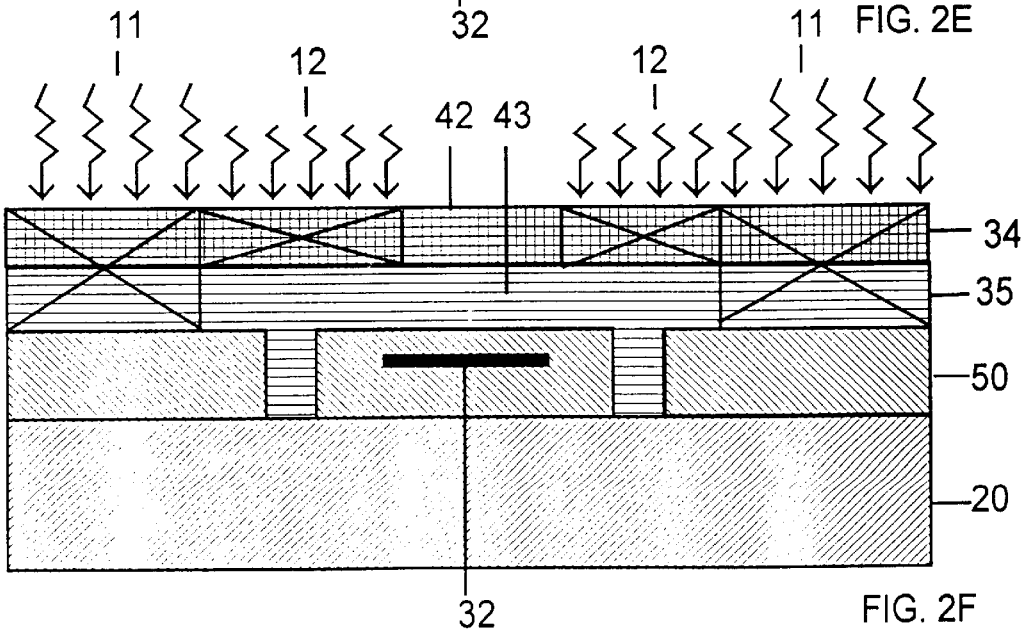

FIG. 2F illustrates the preferred embodiment exposure process. Instead of using two masks, one to define the fluid-well as in FIG. 2D and one to define an orifice opening 42 as in FIG. 2E, only one mask is used. This approach reduces the possible alignment mistakes when using two separate masks. This mask is comprised of three separate density regions per orifice opening (see FIGS. 6A and 6B) forming a multi-density level mask. One region is essentially non-opaque to the electromagnetic energy. The second region is partially opaque to the electromagnetic energy. The third region is completely opaque to the electromagnetic energy.

The first region allows a strong intensity of electromagnetic energy 11 to pass through the mask to fully cross-link and define the orifice layers where no photoimagable material is to be removed. Both top orifice layer 34 and lower orifice layer 35 are cross-linked to prevent removal during developing. The second region is designed to allow only a lower intensity of electromagnetic energy 12 through to cross-link the top orifice layer 34 while leaving the material beneath the second region in lower orifice 35 uncross-linked. The third region (fully opaque) is used to define the shape and area of the orifice opening 42. Because no electromagnetic energy is allowed through this third region, the cross-linking polymer beneath the opaque third region of the mask will not be exposed thus will be removed when developed later.

Figure 2G:
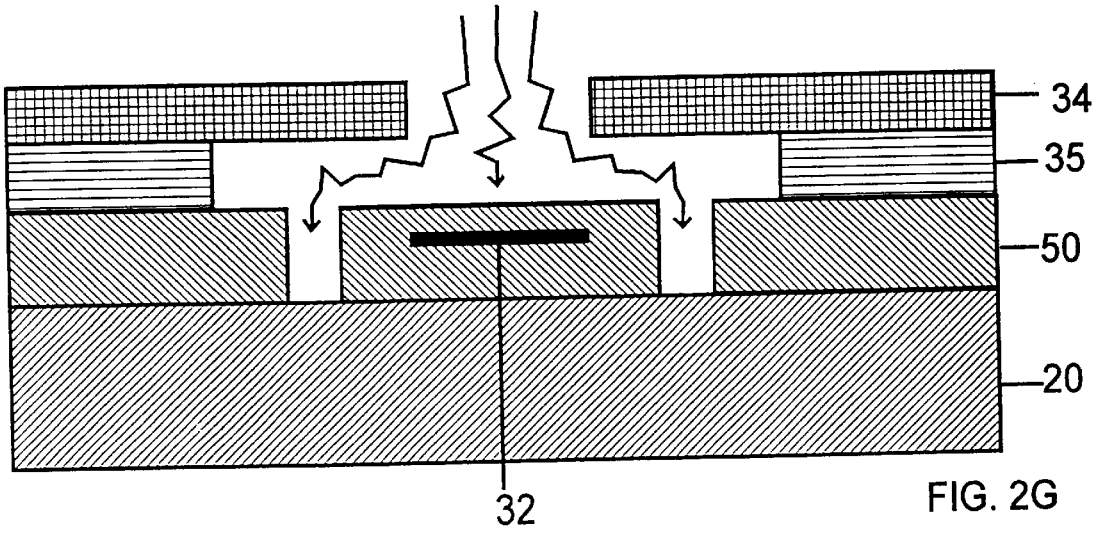

FIG. 2G illustrates the developing process step where material in the top orifice layer 34 and lower orifice 35, including the material in fluid-feed slots 30, is removed. An examplary process is to use a 7110 Solitec developer tool with a 70 sec. development in NMP @ 1 krpm, and 8 sec mix of IPA & NMP @ 1 krpm, a 10 sec. rinse with IPA @ 1 krpm, and a 60 second spin @ 2 krpm.

Figure 2H:
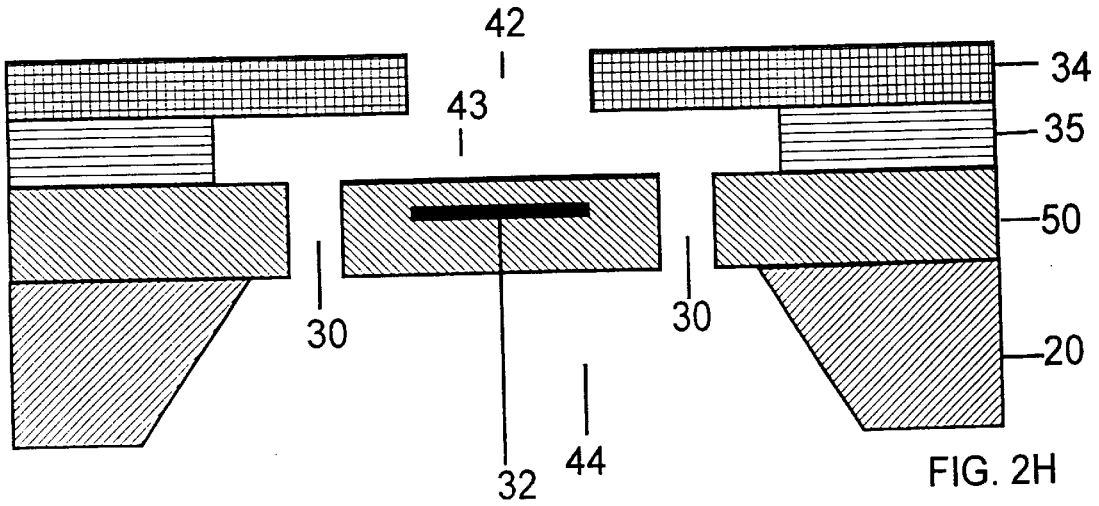

FIG. 2H illustrates the result after a tetramethyl ammonium hydroxide (TMAH) backside etch process (see U. Schnakenburg, W. Benecke and P Lange, TMAHW Etchants for Silicon Micromachining, Tech. Dig. 6$^{th}$ Int. Conf. Solid State Sensors and Actuators (Tranducers '91), San Francisco, Calif., USA, Jun. 24–28, 1991 pp. 815–818) is performed to create fluid feed channel 44 which opens into fluid feed slots 30 to allow fluid to enter fluid-well chamber 43 and ultimately ejected out of orifice opening 42.

Figure 3A:
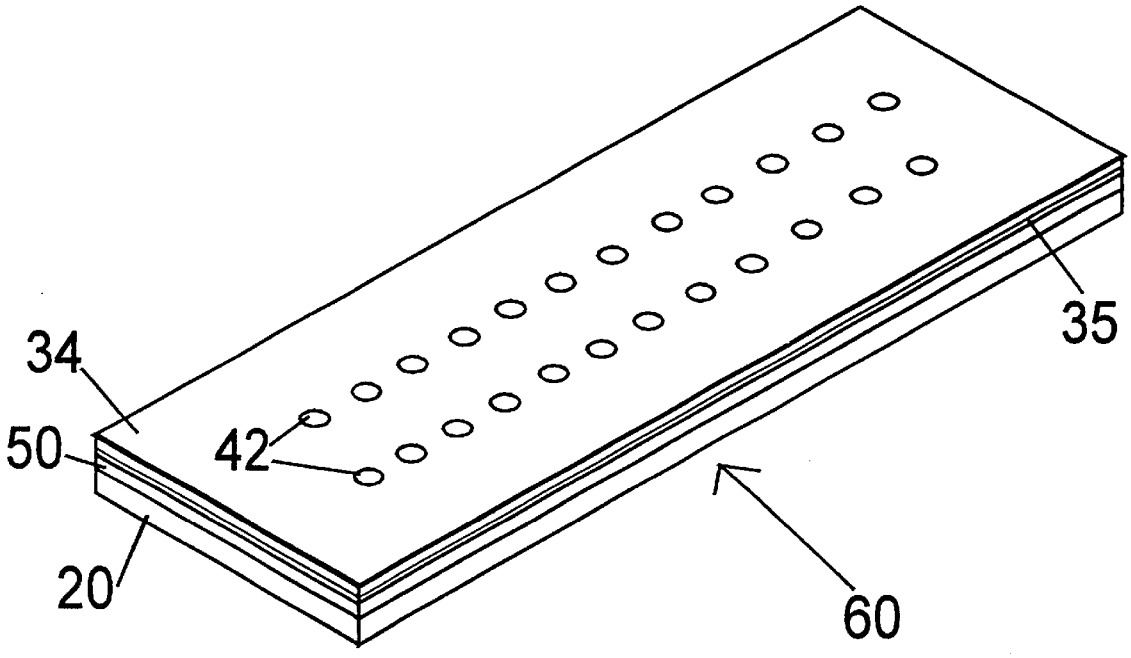
FIG. 3A is the top view of a printhead showing multiple orifices.

FIG. 3A represents an exemplary printhead 60 which comprises a plurality of orifice opening 42 found in top orifice layer 34 and lower orifice layer 35. The orifice layers are applied on a stack of thin-film layers 50, which has been processed on semiconductor substrate 20.

Figure 3B:
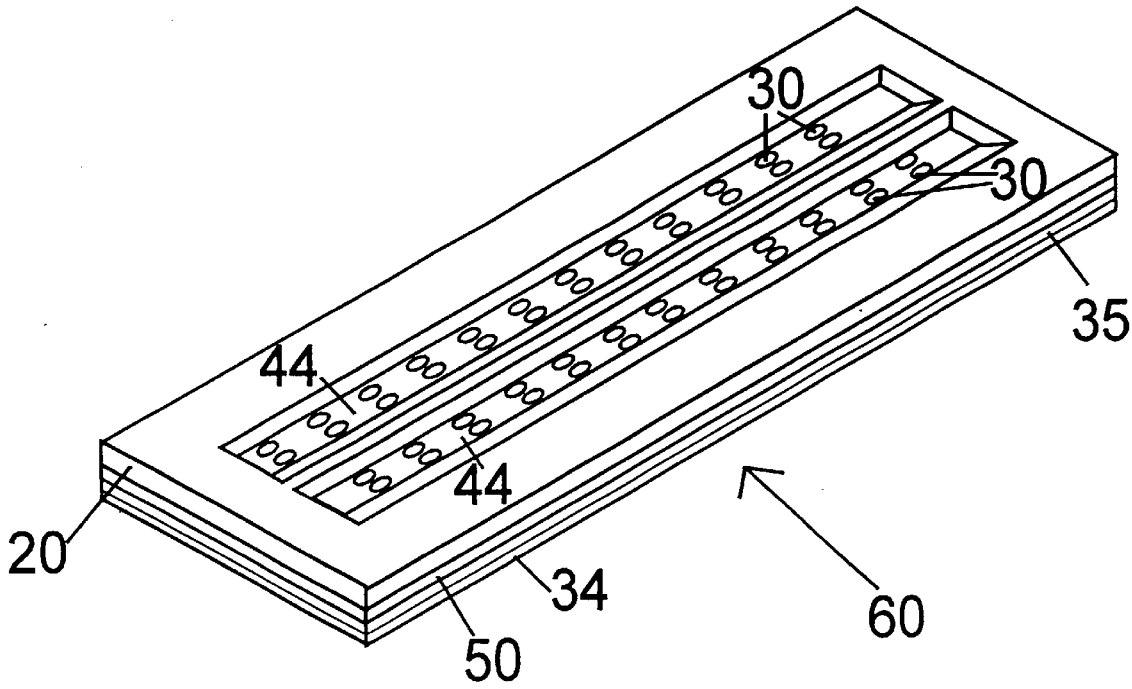
FIG. 3B is the bottom view of the printhead shown in FIG. 3A.

FIG. 3B illustrates the opposite side of printhead 60 to reveal fluid feed channels 44 and fluid feed slots 30.

Figure 4:
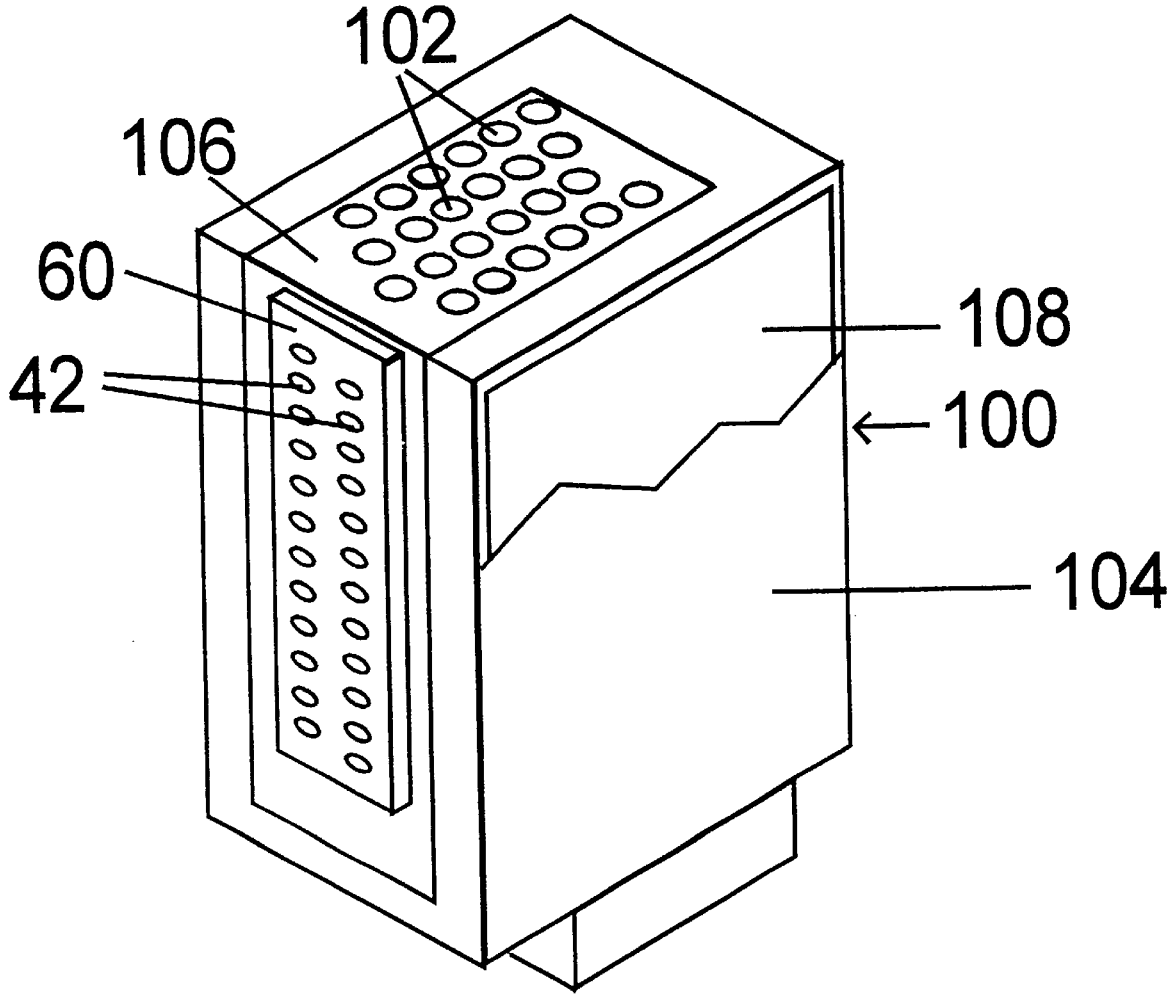
FIG. 4 shows a print cartridge that utilizes a printhead, which may employ the present invention.

FIG. 4 illustrates an exemplary embodiment of a print cartridge 100, which uses printhead 60. Such a print cartridge could be similar to HP51626A available from Hewlett-Packard Co. Printhead 60 is bonded onto a flex-circuit 106 that couples control signals from electrical contacts 102 to the printhead 60. Fluid is held in the fluid reservoir 104, which comprises a fluid delivery assemblage of which an exemplary type, a sponge 108 and standpipe (not shown), is exhibited. The fluid is stored in sponge 108 and delivered to printhead 60 through the standpipe.

Figure 5:
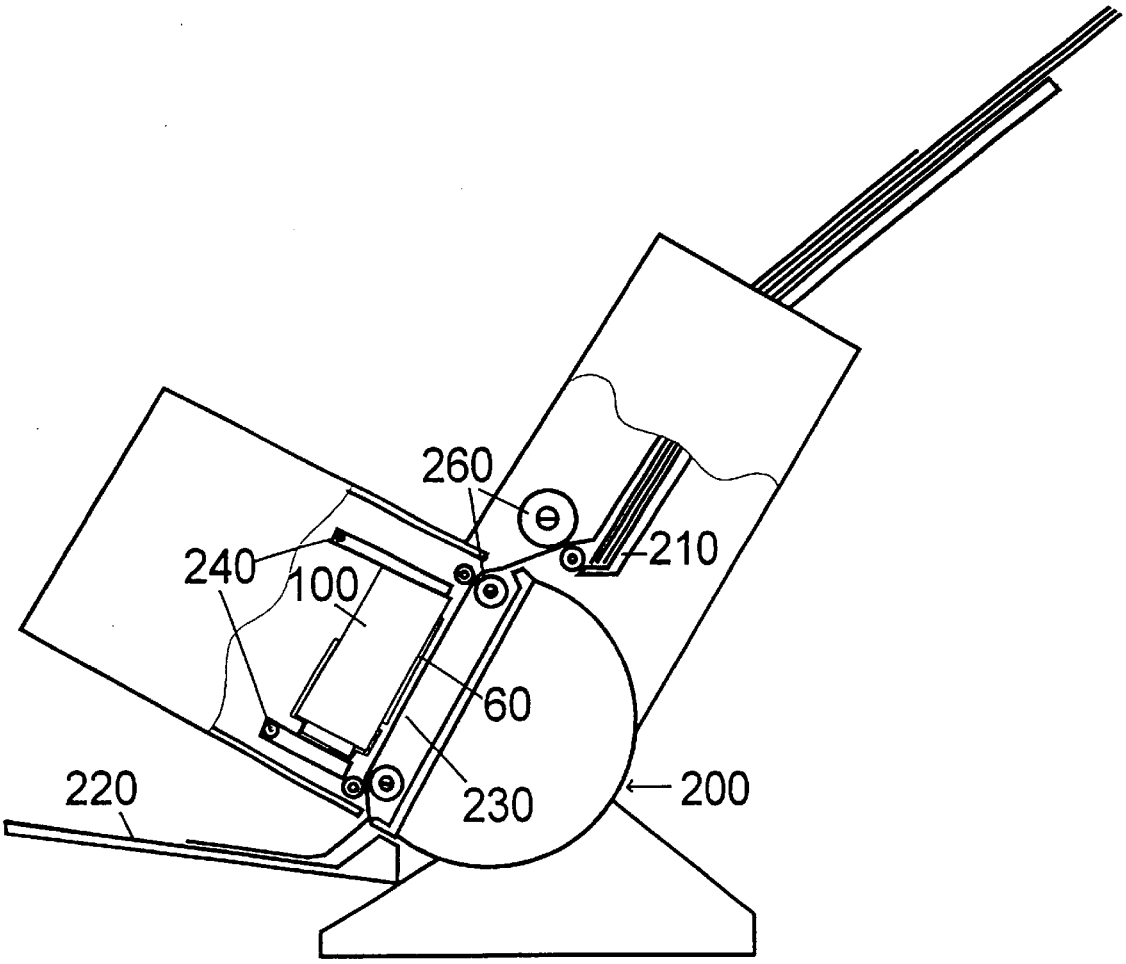
FIG. 5 shows a printer mechanism using a print cartridge that has a printhead, which may employ the present invention.

FIG. 5 illustrates an exemplary liquid jet recording apparatus 200, similar to a Hewlett-Packard Deskjet 340 (C 2655A) using the print cartridge 100 of FIG. 4. Medium 230 (such as paper) is taken from the medium tray 210 and conveyed along its length across the print cartridge 100 by the medium feed mechanism 260. The print cartridge 100 is conveyed along the width of the medium 230 on a carriage assemblage 240. Medium feed mechanism 260 and carriage assembly 240 together form a conveyance assemblage for transporting the medium 230. When the medium 230 has been recorded onto, it is ejected on medium output tray 220.

Figure 6A:
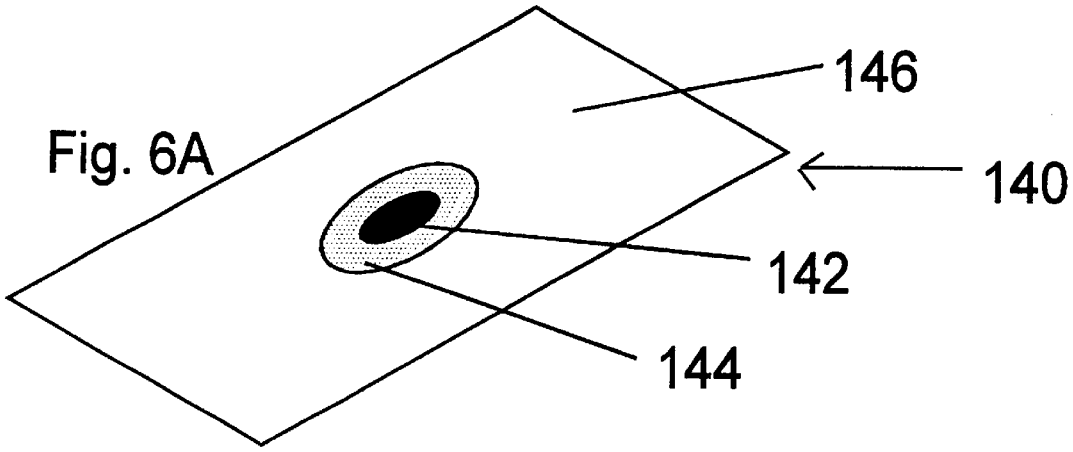
FIG. 6A illustrates a mask pattern used to create an alternate embodiment of the invention.

FIG. 6A illustrate a single multi-density level mask 140; this is used to form the orifice opening 42 in an alternative embodiment of the present invention. The opaque area 142 is used to define the shape and area of the orifice opening 42. Partially opaque area 144 is used to define the shape and area of the fluid-well. Non-opaque area 146 is essentially transparent to the electromagnetic energy and this area of the mask defmes those areas of the top orifice layer 34 and lower orifice layer 35 which will be cross-linked and not removed when developed. The shape of opaque area 142 matches the geometric shape of partially opaque area 144 in order to optimize the developing process.

Figure 6B:
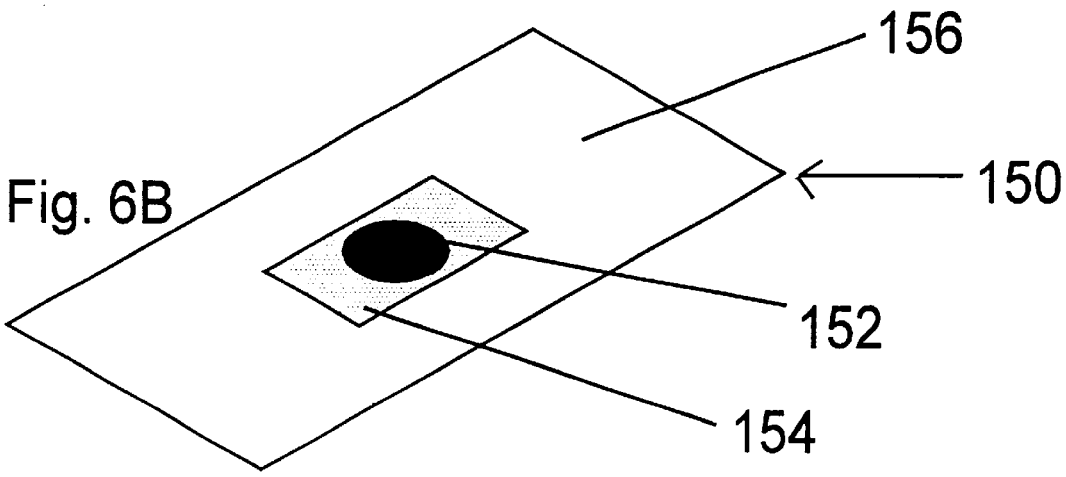
FIG. 6B illustrates a mask pattern that is possible using the preferred embodiment of the invention.

FIG. 6B illustrates the preferred embodiment of the single multi-density level mask 150 in which the geometric shape of the opaque area 152 is different from the geometric shape of the partially opaque area 154. This technique is allowed due to the direct imaging method that allows for separate definition of the fluid-well shape and orifice opening shape. This technique allows for optimal design of the fluid-well to allow for fast refill rates, bubble blow back percentage and maximum density of multiple orifices on a printhead. When a fluid drop is exjected from an orifice, the drop has a main body shape and a trailing tail, which combined form the drop volume. The direct imaging method allows for the optimal design of orifice opening 42 to provide the proper volume of fluid ejected, the tail design of the ejected fluid and shape of the fluid as it exits the orifice, which allows for minimizing breakup of the fluid on its flight path to the medium. Non-opaque area 156 is essentially transparent to the electromagnetic energy and this area of the mask defines those areas of the top orifice layer 34 and lower orifice layer 35 which will be cross-linked and not removed when developed. In this embodiment, an exemplary mask would have a transmisivity for non-opaque area 156 of essentially 100%, a transmisivity for partially opaque area 154 is essentially 20%, and the transmisivity for opaque area 152 is essentially 0%.

The ability to have different shapes allows for the fluid feed slots 30 to be placed further away from the energy dissipation element 32 to reduce the possibility of gulping the blowback of the bubble thus limiting air injection in through the orifice.

Furthermore, due to the ability to control the thickness of both the lower orifice layer 35 and the upper orifice layer 34 with the ability to control the individual shapes of the fluid-well and orifice opening, a general design for an orifice architecture can be accomplished.

Figure 7A:
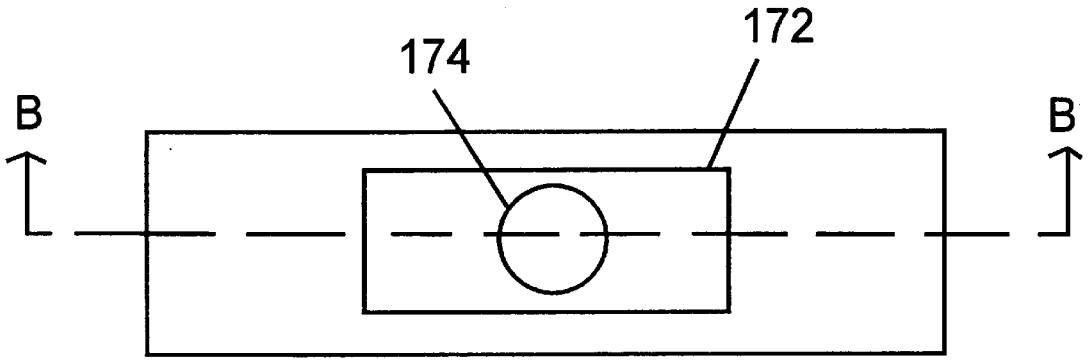
FIG. 7A illustrates the top view of the preferred embodiment of the invention.
Figure 7B:
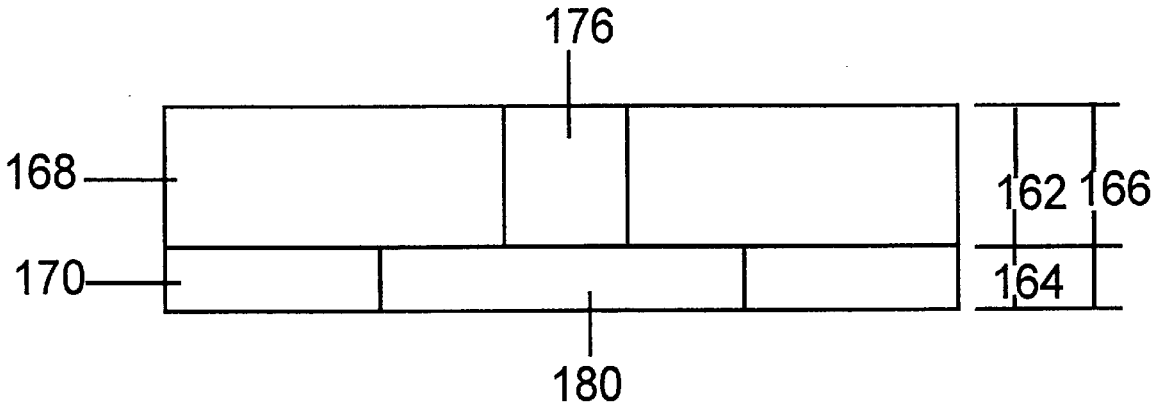
FIG. 7B illustrates a side view of the preferred embodiment of the invention showing the relevant dimensions used to define the reentrant orifice.

FIG. 7A illustrates the top view of the preferred orifice architecture. Orifice opening 174 is a circular shape and fluid-well 172 is of a rectangular shape. FIG. 7B illustrates the side view of the orifice as seen through the BB perspective of FIG. 7A. The top orifice layer 168 has a top orifice height 162, which along with the area of orifice opening 174 determines the volume of orifice chamber 176. The lower orifice layer 170 has a lower orifice height 164, which along with the area of fluid-well 172 determine the volume of the fluid-well chamber 180. The total orifice height 166 is the sum of both top orifice height 162 and lower orifice height 164. The ratio of the lower orifice height 164 to the upper orifice height 162 defines a critical parameter, the height ratio, where:

height_ratio=lower_orifice_height/top_orifice_height.

This height ratio controls both the overshoot volume of the ejected drop, related to the length of its trailing tail, and the refill time, the time required for refilling the orifice with fluid after fluid ejection.

Figure 8:
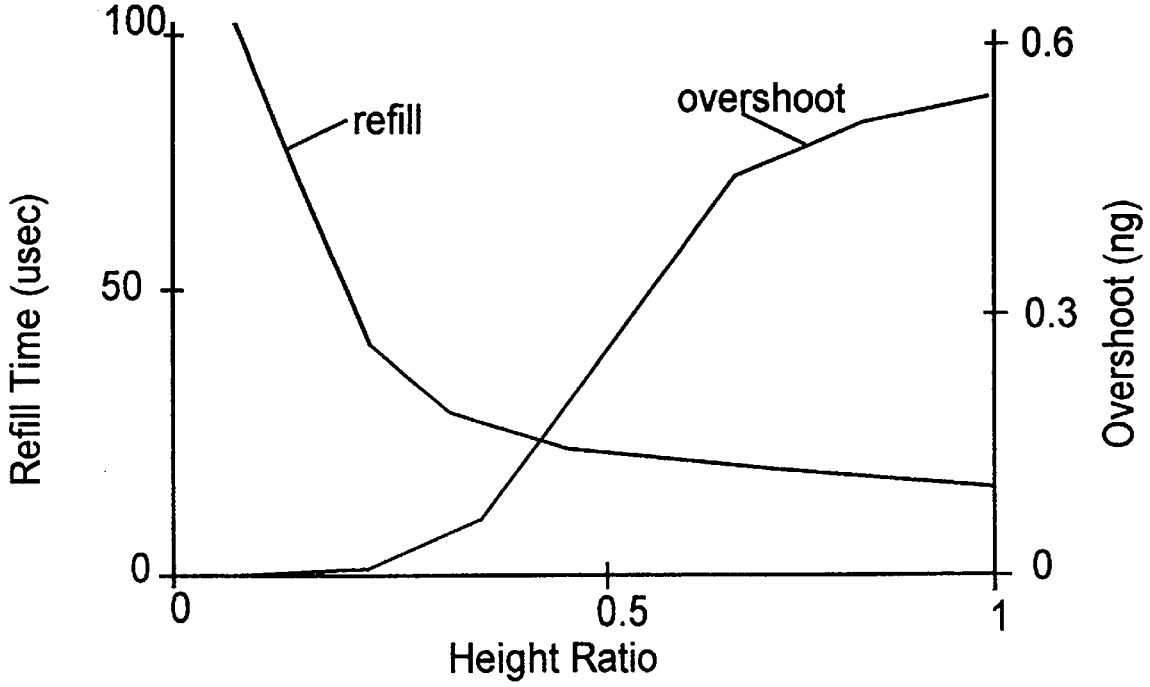
FIG. 8 is a graph representing the design tradeoffs of refill time and overshoot based on the height ratio of the reentrant orifice of the preferred embodiment.

FIG. 8 is a graph that illustrates the effect of the height ratio vs. the refill time and the height ratio vs. the overshoot volume for an exemplary orifice diameter of 16 $\mu$m and a fluid-well length of 42 $\mu$m and width of 20 m. Using this graph would allow the designer of a printhead to choose the layer thickness for a desired ejected drop shape.

FIGS. 9A to 9E illustrate the steps of an alternate embodiment of the invention which uses a single layer of slow cross-linking polymer and employs an underexposure and an overexposure of electromagnetic energy to the slow crosslinking polymer material as a method to form the separate layers.

Figure 9A:
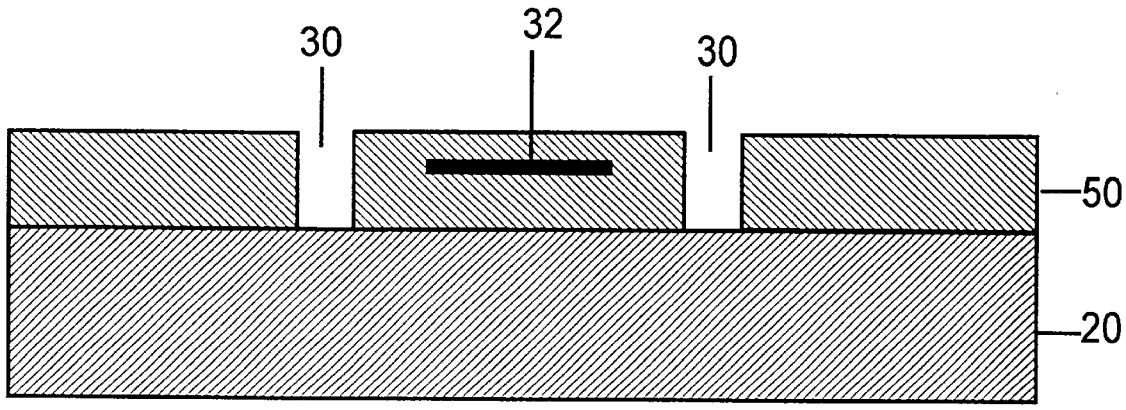
FIG. 9A through FIG. 9G illustrate the process steps to create a single layer version of the in-situ orifice.

FIG. 9A illustrates a processed semiconductor substrate 20 which has a stack of thin-film layers 50 applied on it, which contain energy dissipation element 32 and fluid feed slots 30.

Figure 9B:
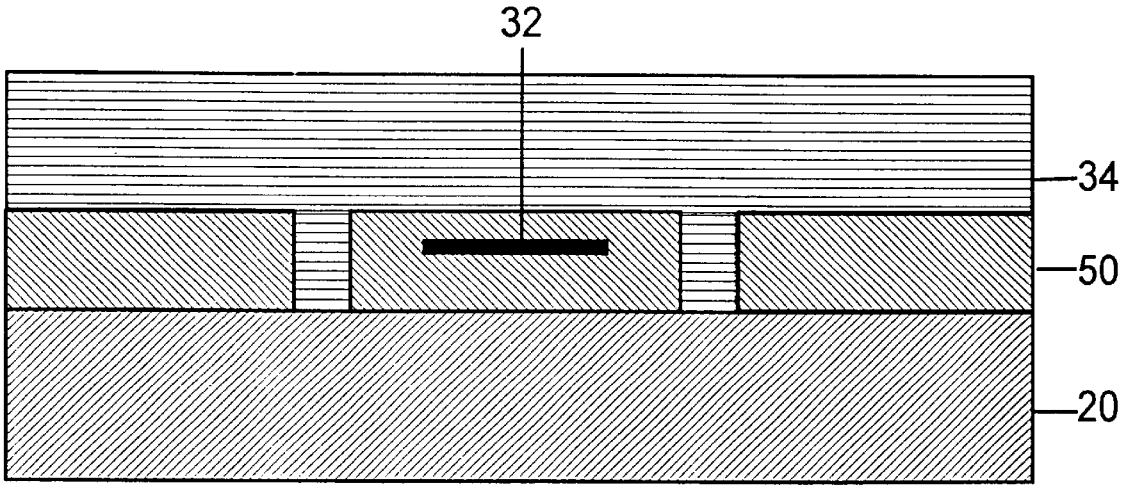

FIG. 9B illustrates the application of a layer of slow cross-linked material 34 on the stack of thin-film layers 50 and fills in fluid feed slots 30.

Figure 9C:
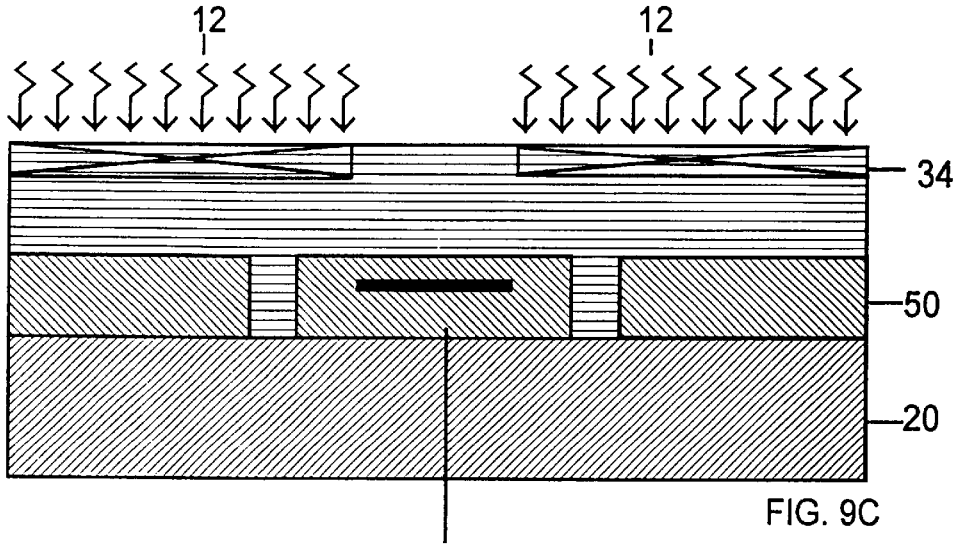

FIG. 9C illustrates the exposure of the layer of slow cross-linking polymer 34 with a low dosage of electromagnetic energy 12 to define the orifice opening. The exposure dosage is just enough to underexpose and cross-link the slow cross-linking polymer to a desired depth. An examplary exposure would be 60.3 mjoules.

Figure 9D:
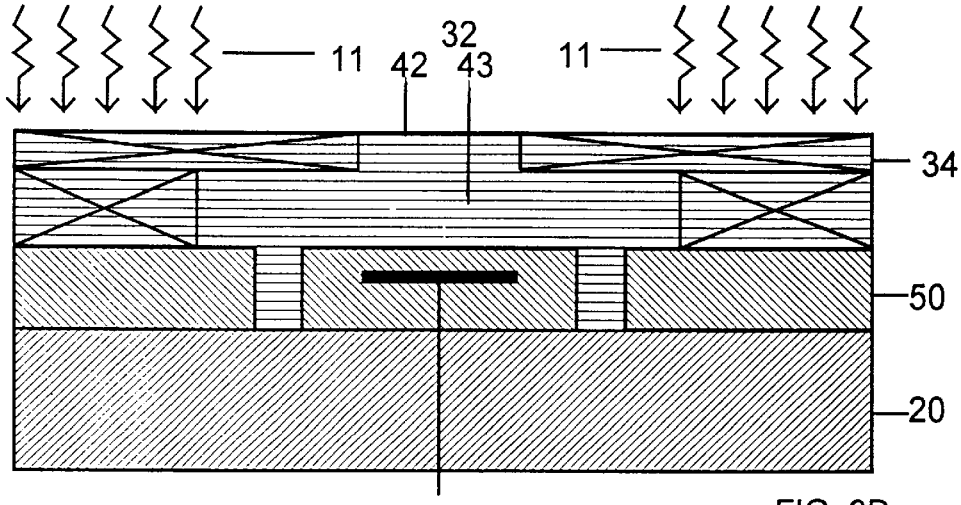

FIG. 9D illustrates the exposure of the layer of slow cross-linking polymer 34 with a high dosage sufficient to overexpose and cross-link all of the layer of slow cross-linking polymer 34 with a high dosage sufficient to cross-link all of the layer of slow cross-linking polymer 34 except where the fluid-well chamber is to exist. An examplary exposure would be 300 mjoules.

Figure 9E:
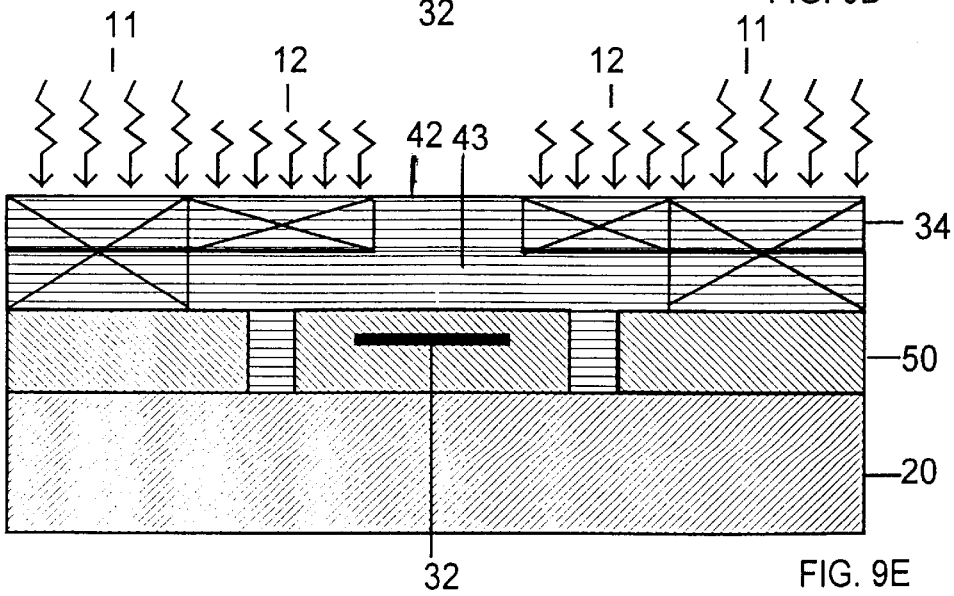

FIG. 9E illustrates an alternate process step to that used in FIGS. 9C and 9D using a single mask having multi-density levels to allow different dosages of electromagnetic energy to be exposed to the layer of slow cross-linking polymer 34. This technique provides for precision alignment of the orifice opening 42 and fluid-well chamber 43 while also reducing the number of process steps.

Figure 9F:
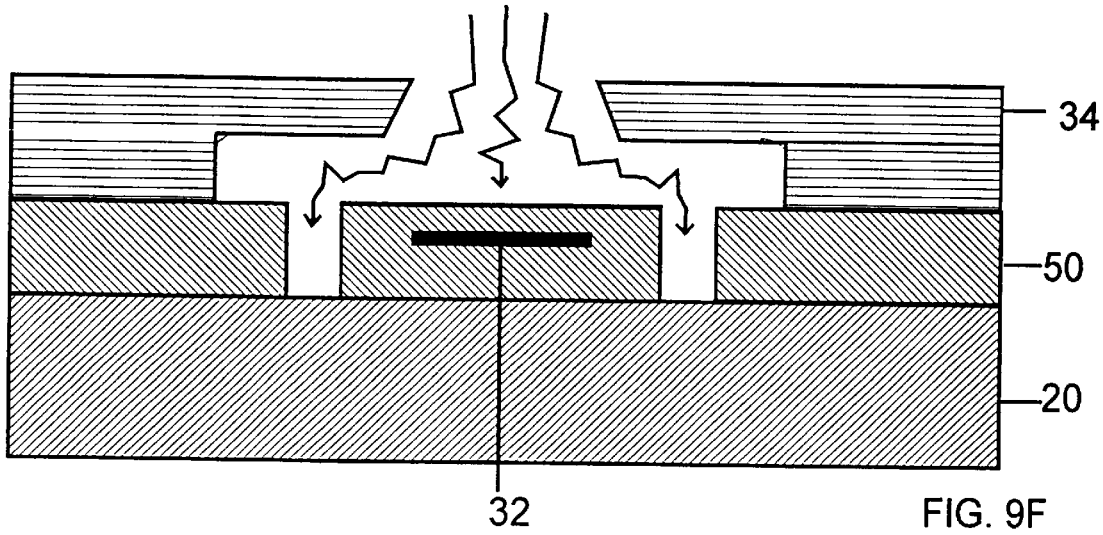

FIG. 9F illustrates the developing process in which the non cross-linked material is removed from the fluid-well chamber and orifice chamber. The orifice chamber has a slight reentrant taper due to less cross-linking of material in the depth of layer of slow cross-linking polymer 34 since the dye or other material mixed within attenuates the electromagnetic energy as it penetrates.

Figure 9G:
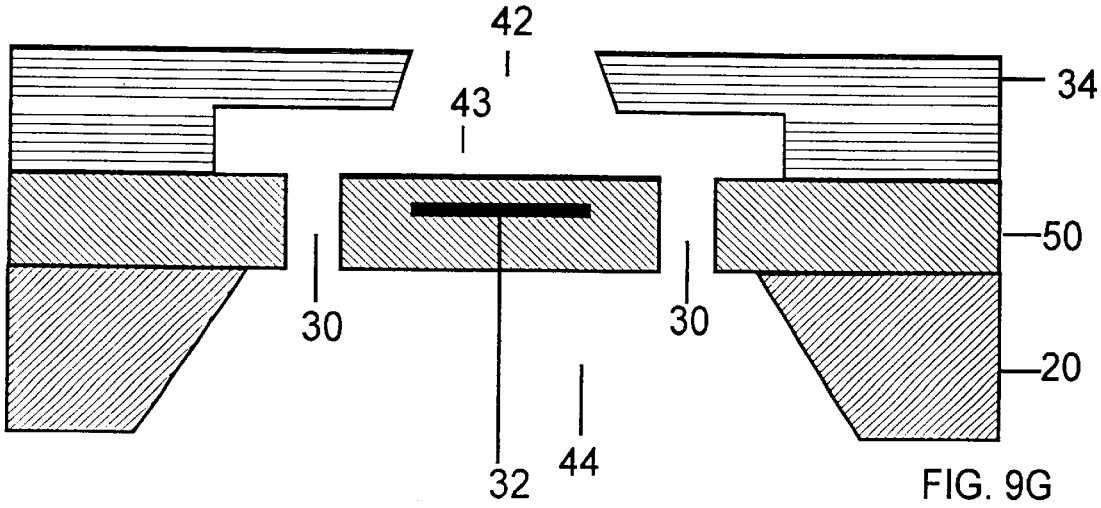

FIG. 9G illustrates the finished result after the backside TMAH etch process to create fluid feed channel 44 which opens into fluid feed slots 30.

FIG. 10A to FIG. 10E illustrates results of the process steps used to produce the multi-density level mask used in the single mask fabrication processes to make the holes in the orifice layer.

Figures 10A, 10B, 10C, 10D, 10E:
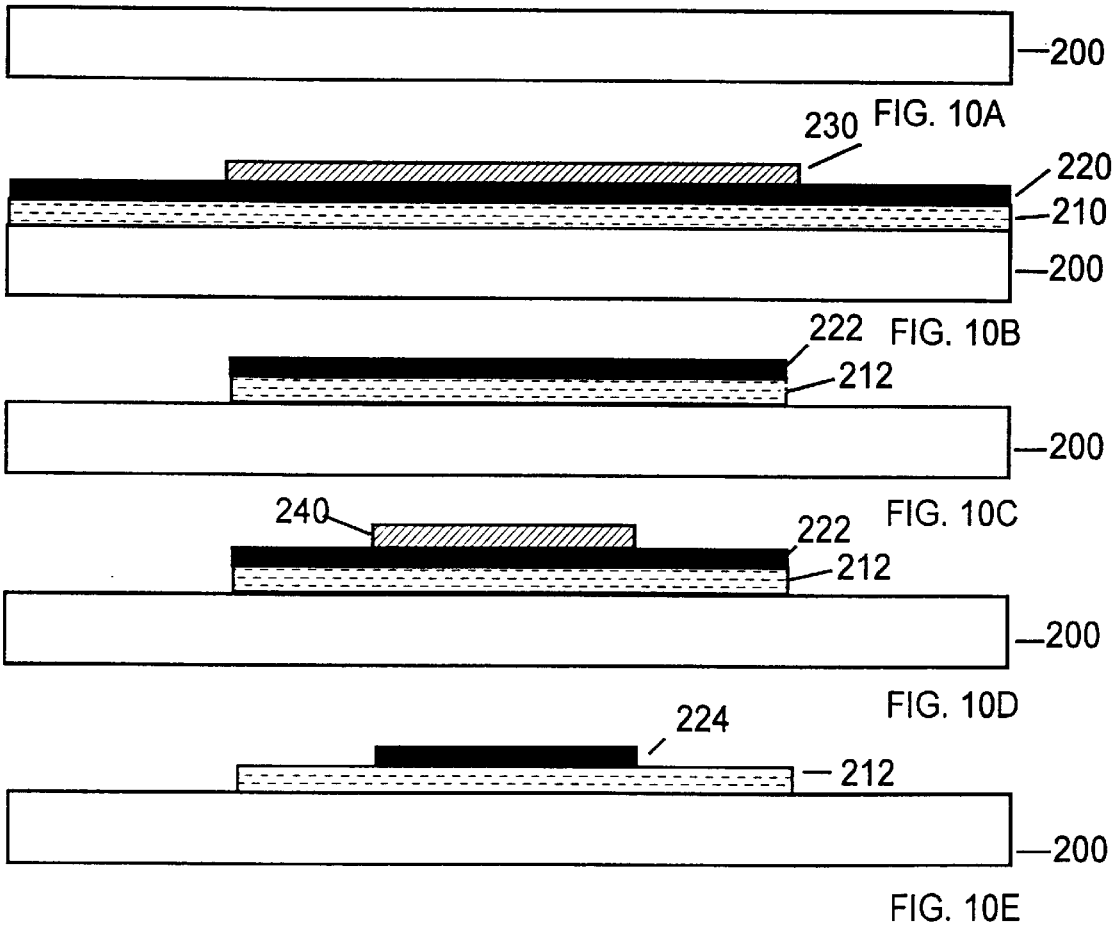
FIG. 10A through FIG. 10E illustrate results in the process to create a multidensity level mask used in the preferred embodiment of the invention.

FIG. 10A illustrates a quartz substrate 200 that is transparent to the electromagnetic energy used to expose the photoimagable polymer used to create the orifice layers. The quartz substrate 200 must be of a suitable optical quality.

FIG. 10B illustrates quartz substrate 200 with a layer of semi-transparent dielectric material 210 applied on it. Such an exemplary material is ferrous oxide ($FeO_2$). On the layer of semi-transparent dielectric material 210 is applied a layer of opaque material 220, an exemplary material being chromium. Both $FeO_2$ and chromium can be deposited using a conventional e-beam evaporator. A layer of negative acting photo-resist is applied on the layer of opaque material 220, exposed to electromagnetic energy and developed to leave a photoresist area 230 which defines the shape and size of the fluid-well chamber.

FIG. 10C illustrates the result after the quartz substrate 200 has been conventionally etched. When the opaque material 220 is comprised of chromium, then an exemplary etch process is a standard KTI chromium etch bath. The quartz substrate 200 is then subjected to another conventional etch process to remove the semi-transparent dielectric material 210 forming semi-transparent layer 212. When $FeO_2$ is used for the semi-transparent dielectric material 210 an exemplary etch process is a plasman etch using an SF6 or CF4 plasma. The remaining photoresist 230 is then stripped.

In FIG. 10D another layer of photoresist is then applied to the quartz substrate 200, exposed to define the orifice opening shape and area then developed to create orifice pattern 240.

FIG. 10E illustrates the result after the quartz substrate 200 is processed in an etch to remove the opaque layer 222 where the orifice pattern 240 is not located thereby creating the opaque layer orifice opening pattern 224. For an opaque material that is chromium, an exemplary etch process is a wet chemical etch so that semi-transparent dielectric layer 212 is not attacked in the etch process.

The direct imaging polymer orifice process is simple, inexpensive, uses existing equipment and is compatible with current thermal fluid jet technology. It provides design flexibility and tight orifice dimension control in allowing for independent control of the orifice and fluid-well geometry. A multi-density level mask design allows for using a single exposure to provide inherent alignment of the orifice and fluid-well to improve yields and consistency.

While different reentrant orifice shapes have been shown, other reentrant shapes are possible using the aforementioned techniques and fall within the spirit and scope of the invention.

The invention addresses the need of tighter fluid jet directional control and smaller drop volume for finer resolution required for vibrant clear photographic printing. In addition, the invention simplifies manufacturing of the printhead, which lowers the cost of production, enables high volume run rates and increases the quality, reliability and consistency of the printheads. The preferred embodiment, and its alternative embodiments of the invention, demonstrate that unique orifice shapes can be created to address additional concerns or to take advantage of different properties of the fluid expelled from the printhead.

What is claimed is:

1. A printhead, comprising:

a substrate having a surface;

a stack of thin-film layers affixed to said surface of said substrate, and defining a fluid feed slot;

a layer of cross-linked polyimide or epoxy with an optical dye applied on said stack of thin-film layers and having a fluid-well defined therein positioned over said fluid feed slot; and a layer of cross-linked polyimide or epoxy with no optical dye applied on said layer of cross-linked polyimide with an optical dye and having an orifice defined therein.

2. The printhead in accordance with claim 1, wherein:

said layer of cross-linked polyimide or epoxy with an optical dye further comprises a thickness of 4 to 30 microns.

3. The printhead in accordance with claim 1, wherein:

said layer of cross-linked polyimide or epoxy with no optical dye further comprises a thickness of 4 to 30 microns.

4. A printhead, comprising:

a substrate having a surface;

a stack of thin-film layers affixed to said surface of said substrate and said stack of thin-film layers defining a fluid feed slot; and a layer of cross-linked polyimide or epoxy with an optical dye applied on said stack of thin-film layers and having a fluid-well defined therein, said fluid-well positioned over said fluid feed slot.

5. A fluid cartridge, comprising:

a printhead, including, a substrate having a first surface and a second surface, a stack of thin-film layers defining a fluid feed slot affixed to said first surface of said substrate and said stack of thin-film layers defining a fluid feed slot, a layer of cross-linked polyimide or epoxy with an optical dye applied on said stack of thin-film layers and having a fluid-well defined therein, and a fluid feed channel defined within said second surface of said substrate and opening into s aid fluid feed slot;

a fluid reservoir; and a fluid delivery assemblage for delivering fluid from said fluid reservoir to said fluid feed channel.

6. A liquid fluid jet recording apparatus, comprising:

a fluid cartridge, including, a printhead, including, a substrate having a first surface and a second surface, a stack of thin-film layers affixed to said first surface of said semiconductor substrate, said stack of thin-film layers further comprising an energy dissipating element, and said stack of thin-film layers defining a fluid feed slot, a layer of cross-linked polyimide or epoxy with an optical dye having a fluid-well defined therein, said layer applied on said stack of thin-film layers, said fluid-well positioned over said fluid feed slot, and a fluid feed channel de fined within said second surface of said semiconductor substrate and opening into said fluid feed slot;

a fluid reservoir;

a fluid delivery assemblage for delivering fluid from said fluid reservoir to said fluid feed channel; and a conveyance assemblage for transporting a recording medium on which recording is effected by said fluid cartridge.

7. A printhead, comprising:

a substrate having a surface;

a stack of thin-film layers affixed to said surface of said substrate, said stack of thin-film layers defining a fluid feed slot; and a layer of cross-linked polyimide or epoxy with an optical dye having a fluidwell defined therein, said fluid-well positioned over said fluid feed slot.

8. A fluid cartridge used to deliver fluid comprising the printhead of claim 7.

9. A liquid fluid jet recording apparatus comprising the fluid cartridge of claim 7.

* * * * *

UNITED STATES PATENT AND TRADEMARK OFFICE

CERTIFICATE OF CORRECTION

PATENT NO. : 6,520,627 B2
DATED : February 18, 2003
INVENTOR(S) : Chen et al.

It is certified that error appears in the above-identified patent and that said Letters Patent is hereby corrected as shown below:

Column 10,
Line 12, delete “s aid” and insert therefor -- said --.

Signed and Sealed this

Twenty-seventh Day of January, 2004

JON W. DUDAS
*Acting Director of the United States Patent and Trademark Office*